US006704967B2

(12) United States Patent
Gianelli et al.

(10) Patent No.: US 6,704,967 B2
(45) Date of Patent: Mar. 16, 2004

(54) SANITARY AIR FRESHENING HANDLE FOR ARTICLES AND ASSOCIATED METHODS

(76) Inventors: Peter A. Gianelli, 1015 N. Lake Davis Dr., Orlando, FL (US) 32806; Penelope M. A. Gianelli, 1015 N. Lake Davis Dr., Orlando, FL (US) 32806

( * ) Notice: Subject to any disclaimer, the term of this patent is extended or adjusted under 35 U.S.C. 154(b) by 0 days.

(21) Appl. No.: 09/911,191

(22) Filed: Jul. 23, 2001

(65) Prior Publication Data

US 2002/0007532 A1 Jan. 24, 2002

Related U.S. Application Data

(60) Provisional application No. 60/219,928, filed on Jul. 21, 2000.

(51) Int. Cl.[7] ..... A45C 13/22

(52) U.S. Cl. ..... 16/422; 16/110.1; 16/443; 16/904; 16/905; 4/246.1

(58) Field of Search ..... 16/422, 110.1, 16/111.1, 443, 904, 905, DIG. 12; 4/212, 246.1; 40/331, 406, 409, 661.12

(56) References Cited

U.S. PATENT DOCUMENTS

| | | | | | |
|---|---|---|---|---|---|
| 3,783,455 | A | * | 1/1974 | Vanderbrook | 16/110.1 |
| 4,574,401 | A | | 3/1986 | Nakajima | |
| 4,707,870 | A | | 11/1987 | Glassco et al. | |
| 4,742,582 | A | | 5/1988 | Giallourakis | |
| D296,658 | S | | 7/1988 | Mead et al. | |
| 4,805,246 | A | * | 2/1989 | De Vargas et al. | 4/231 |
| 4,839,928 | A | | 6/1989 | Probasco | |
| 4,843,656 | A | | 7/1989 | Forman | |
| 4,850,062 | A | | 7/1989 | Gibson et al. | |
| 4,875,251 | A | | 10/1989 | Hazard | |
| 4,920,586 | A | * | 5/1990 | Giallourakis | 4/246.1 |
| 4,951,325 | A | | 8/1990 | Tack | |
| 5,058,215 | A | * | 10/1991 | Sims | 16/443 |

(List continued on next page.)

FOREIGN PATENT DOCUMENTS

| | | | | |
|---|---|---|---|---|
| JP | 10225400 | A | * | 8/1998 |
| JP | 11151182 | A | * | 6/1999 |
| JP | 2000107079 | A | * | 4/2000 |
| JP | 2000333878 | A | * | 12/2000 |
| JP | 200117353 | A | * | 1/2001 |
| WO | WO 91/11949 | | * | 8/1991 |

*Primary Examiner*—Chuck Y. Mah
(74) *Attorney, Agent, or Firm*—Allen, Dyer, Doppelt, Milbrath & Gilchrist, P.A.

(57) ABSTRACT

A disposable handle for an article includes a connecting member connected to a surface of the article, and a handle member having a proximal connecting end connected to the connecting member and a distal handle end, the handle member comprising an air freshening scent, an antimicrobial agent, and a phosphorescent material producing a glow to help a user locate the handle member in the dark.

16 Claims, 4 Drawing Sheets

U.S. PATENT DOCUMENTS 5,086,523 A * 2/1992 De Mott et al. ..... 16/421
D325,510 S 4/1992 Slye
D326,216 S 5/1992 Hampton
D329,186 S 9/1992 Sorensen
D329,187 S 9/1992 Sorensen
D336,954 S 6/1993 Paglia
5,222,260 A 6/1993 Piper
5,279,000 A 1/1994 Mercier et al.
D348,601 S 7/1994 Borja et al.
D351,550 S 10/1994 Clark et al.
D351,979 S * 11/1994 Sykes et al. ..... D8/307
D356,366 S 3/1995 Denapoli
D363,976 S 11/1995 Vinal
5,511,252 A * 4/1996 Kreemer ..... 4/246.1
D370,722 S 6/1996 Lick, III
D371,434 S 7/1996 Ouzounian
D372,965 S 8/1996 Villeneuve
D373,819 S 9/1996 Suynov
5,553,332 A * 9/1996 Hazard ..... 4/246.1
5,590,425 A 1/1997 Janik, Jr.
5,592,700 A 1/1997 Benesse
D382,949 S 8/1997 Ouzounian
5,659,902 A 8/1997 Roberts, Jr.
D386,253 S 11/1997 Black
5,727,258 A * 3/1998 Derouin ..... 4/246.1
D395,489 S 6/1998 Abusaad
D399,937 S 10/1998 Earleywine
D406,884 S 3/1999 Goss
5,963,992 A * 10/1999 Bonner ..... 4/246.1
6,001,048 A * 12/1999 Taylor ..... 482/81
D427,293 S * 6/2000 Yastrop ..... D23/303
6,163,894 A * 12/2000 Simonds ..... 4/246.1

* cited by examiner

SANITARY AIR FRESHENING HANDLE FOR ARTICLES AND ASSOCIATED METHODS

RELATED APPLICATION

This application claims priority from co-pending provisional application Ser. No. 60/219,928 which was filed on Jul. 21, 2000, and which is incorporated herein by reference in its entirety.

FIELD OF THE INVENTION

The present invention relates to the field of disposable handles, and more particularly, to a sanitary, disposable, glow-in-the-dark, air freshening handle particularly suitable for toilet seats, lids, drawers, and other potentially contaminated articles, the disposable handle incorporating an air freshening scent, and an antimicrobial agent to reduce microbial contaminants on the handle.

BACKGROUND OF THE INVENTION

Many people display aversion for touching articles which may be contaminated with microorganisms. Such aversions are not unfounded, however, since it is well known, for example, that an important mechanism for the spread of influenza virus and a number of other infections is by direct contact through contaminated hands and objects. Further, many people dislike touching articles such as toilet seats, toilet lids, and waste container lids for fear of possible transmission of disease causing microorganisms. Notwithstanding such dislike, it is often necessary to lift a toilet lid in preparation for using the toilet. Revulsion at touching a toilet seat may be particularly associated with children, as it is natural for them to associate a toilet with human wastes. It is also to be expected that such negative association would be heightened in relation to public toilets, which are used by many different and unknown people in the course of a day. Nevertheless, the need for occasionally handling a toilet lid or toilet seat cannot be entirely avoided, whether in the home or at public facilities.

SUMMARY OF THE INVENTION

With the foregoing in mind, the present invention advantageously provides a disposable, air-freshening, glow-in-the-dark, antimicrobial handle for an article, and particularly for articles such as toilet seats, toilet lids, waste can lids, drawers, and cabinet doors.

The disposable handle includes a connecting member, and a handle member. The connecting member is connected to a surface of the article, for example to an underside of a toilet seat, preferably by an adhesive connection. The handle member has a proximal connecting end and a distal handle end. The distal handle end is preferably positioned substantially opposite the proximal connecting end. The handle member is best positioned on an article by having the proximal connecting end connected to the connecting member, and having the distal handle end extending beyond an outer periphery of the article to thereby provide a handle for the article. The handle member comprises an air freshening scent which diffuses into the air, an antimicrobial agent, and a phosphorescent material which glows so as to help a user locate the toilet seat in the dark. In a preferred embodiment of the invention, the air freshening agent and antimicrobial agent are incorporated in the material from which the handle member is fabricated. The phosphorescent material is preferably contained in at least one localized spot along the handle member, and may be particularly configured in an ornamental design such as part of a flower, a star, the eye of a fish-shaped handle, and the like.

The invention also includes a kit for disposing a handle on an article. The kit comprises a connecting member for connecting to a surface of an article, a handle member as described above, and a container for holding the connecting member and handle member. The container is preferably a hermetically sealed plastic pouch serving for shipping, stocking, commercially displaying and selling the invention.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

FIGS. 1 through 4 illustrate preferred embodiments of the present invention as used with a toilet seat, an embodiment employed here solely for purposes of example. Those skilled in the art will readily appreciate that the invention is described and illustrated with respect to a toilet, but is suitable for use with many other articles with which a user may not want to have direct contact, particularly due to sanitary concerns due to possible transfer of microorganisms to the user's hands.

Figure 1:
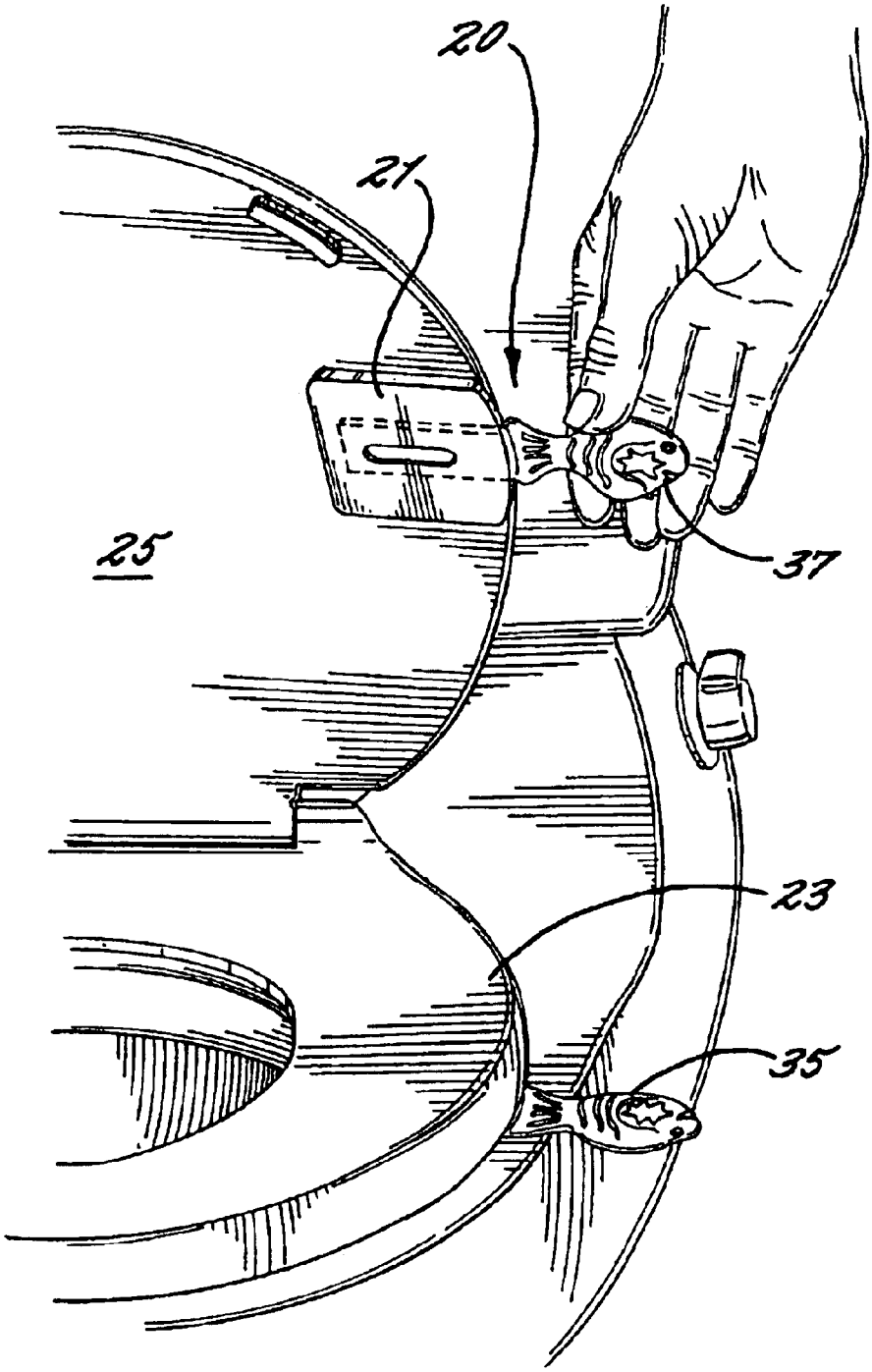
FIG. 1 shows a front perspective view of an embodiment of the present invention in use on a toilet lid and toilet seat.
Figure 3:
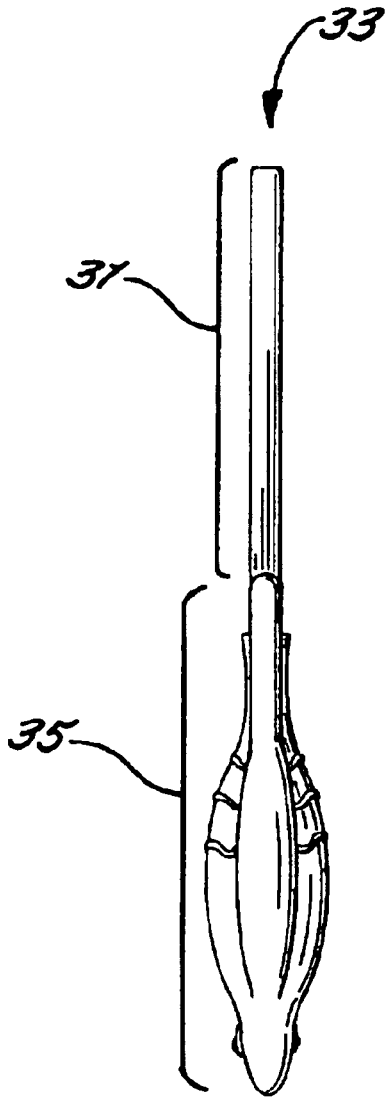
FIG. 3 is a side plan view of the handle member of FIG. 2.

The invention comprises a disposable handle device 20 which incorporates an air freshening scent, a phosphorescent night glow, and an antimicrobial agent. Handle device 20 includes two components, as shown in the figures, a connecting member 21 and a handle member 33. The connecting member 21 attaches to the underside of a toilet seat 23 or toilet lid 25 through a connector 27 which preferably comprises two-sided adhesive tape. Connecting member 21 may be advantageously made of a plastic material and is shaped as a substantially flat member so as to fit in the narrow space generally found between the rim of a toilet bowl and the undersurface of a toilet seat, between toilet seat and toilet lid, or other restricted spaces. As shown in FIG. 3, connecting member 21 includes a connecting slot 29 for therein receiving the proximal connecting end 31 of handle member 33. Connecting member 21 is appropriately dimensioned to fit within the underside contours of a toilet seat 23 or toilet lid 25, as shown in FIG. 1. An alternative embodiment for connecting member 21 includes a shim 24 used when necessary to adapt the connecting member to a curved article, such as a curved undersurface as found on some toilet seats, toilet lids, or waste can lids.

The handle member 33 has a proximal connecting end 31 and a distal handle end 35, which is generally opposite the connecting end. A connecting end 31 is positioned at the proximal end of handle member 33 for engaging connecting slot 29 as shown in FIG. 1. Once handle member 33 is connected to the toilet seat 23 or lid 25, the distal handle end 35 extends beyond a lateral periphery of the seat or lid, also seen in FIG. 1.

Figure 2:
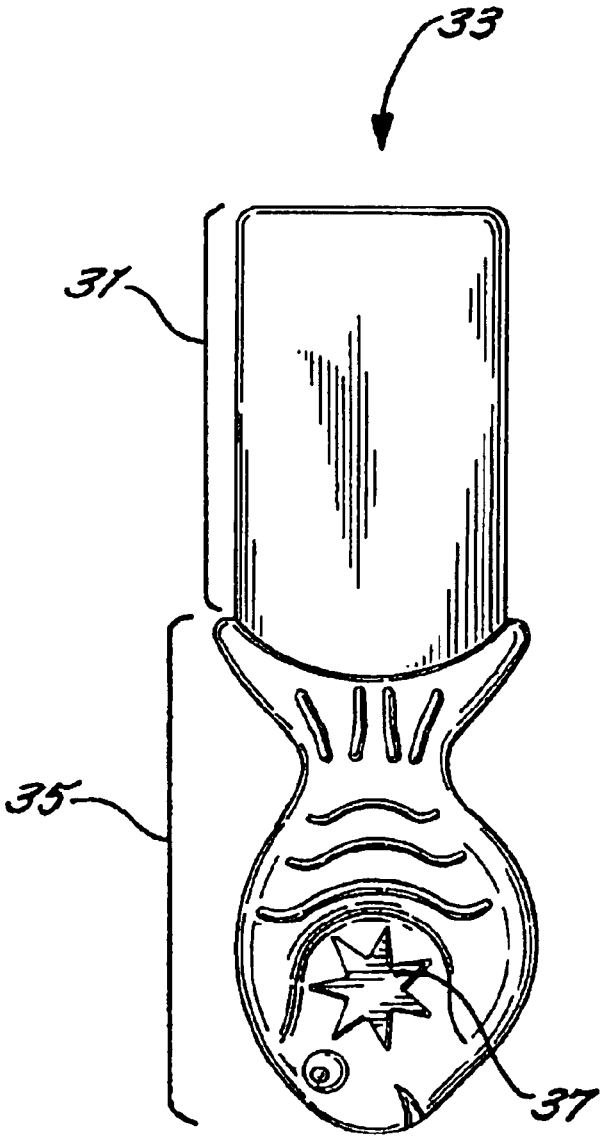
FIG. 2 is a top plan view of the handle member of FIG. 1 configured in the ornamental design of a fish.
Figure 4:
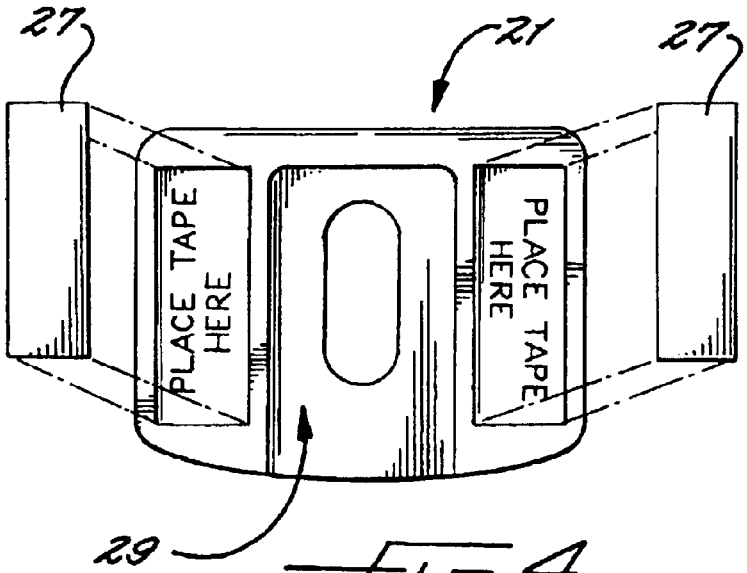
FIG. 4 shows a bottom plan view of the connector member of the invention of FIG. 1.
Figure 5:
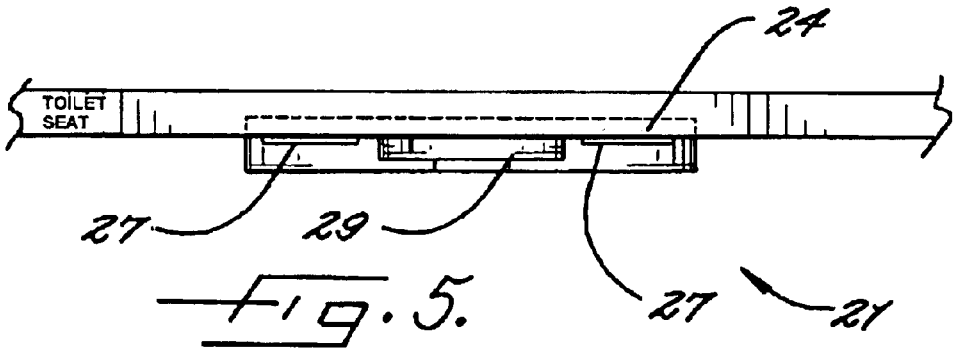
FIG. 5 illustrates a side elevation of the connector member of FIG. 4.
Figure 6:
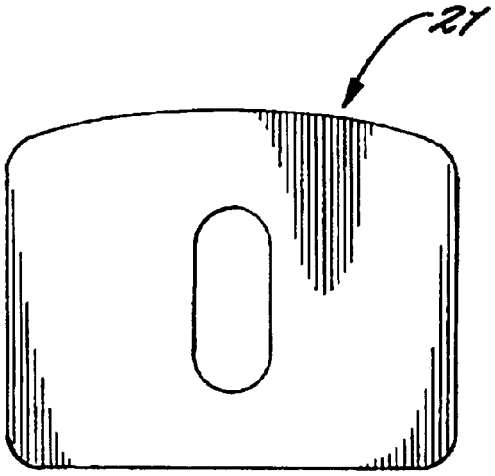
FIG. 6 shows a top plan view of the connector member of FIG. 4.
Figure 7:
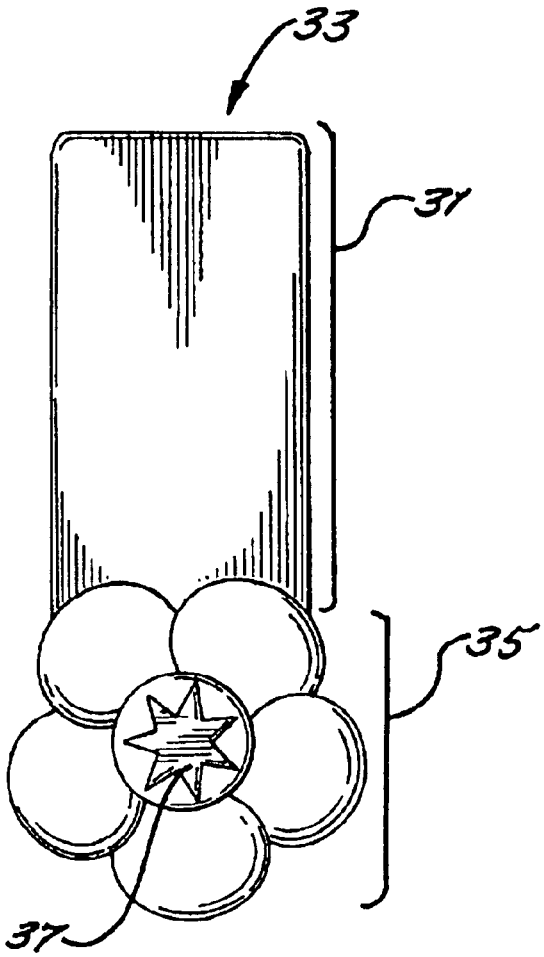
FIG. 7 illustrates a top plan view of the handle member of FIG. 1 configured in. the ornamental design of a flower.
Figure 8:
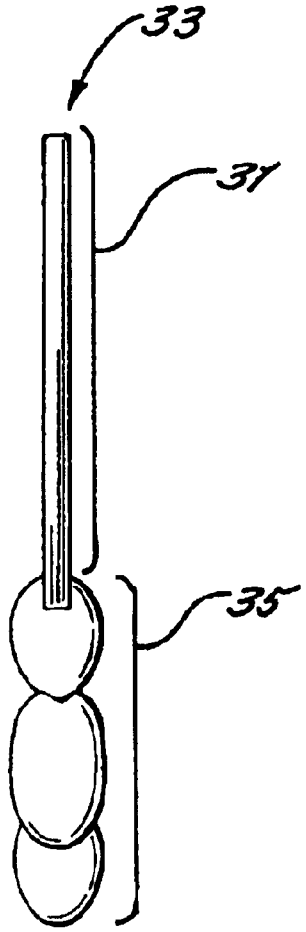
FIG. 8 is a side plan view of the handle member of FIG. 7.

In a preferred embodiment of the invention the distal handle end 35 of handle member 33 comprises an ornamental design, which is preferably formed as an integral portion of handle member 33, or alternatively may be a separate component connected to the handle member. Shown in FIGS. 1 and 2 is an ornamental design portraying a tropical fish, however, those skilled in the art will recognize that a wide variety of ornamental designs may be expressed in this invention. As a further example, FIG. 4 illustrates the handle member comprising the design of a flower. A particularly useful ornamental design would incorporate the likeness of a cartoon character, to thereby encourage children to use the handle for lifting the toilet seat or lid.

As noted above, the antimicrobial agent is preferably incorporated in the material from which the handle member is fabricated. The antimicrobial is preselected from agents known to be effective in helping reduce the microbial count on surfaces. By reducing the microbial count on the handle member, the antimicrobial agent thereby also reduces transfer of microorganisms to the hands of a user. The skilled will recognize that transfer of microorganisms by hands is a major mechanism of disease transmission, and that there are a number of antimicrobial agents that may suitably be employed in the invention for this purpose.

A further aspect of the invention includes an air freshening scent which is preferably incorporated into the material from which handle member 33 is constructed. The scent generally diffuses slowly into the air from handle member 33 to provide an air freshening function. Air freshening scents in the invention are most advantageously coordinated with the ornamental appearance expressed in handle member 33, for example, an ocean scent may be used together with an ornamental shell design, or a forest fragrance may be incorporated into an ornament shaped as foliage. Additionally, the air freshening scent "flavor" may also be conveniently coordinated with a predetermined color incorporated into the handle member, for example, blue with a vanilla scent, pink with a honeysuckle scent, red with cinnamon, lavender with tutti fruti, and yellow with a pina colada scent. Other possible combinations of design appearance, color, and/or scent will undoubtedly occur to the skilled. As the scent diffuses from the handle material, the air freshening capacity of the handle will eventually diminish and disappear. The scented handle member 33 is, however, easily replaceable when air freshening becomes ineffective by sliding connecting end 31 out of connecting slot 29 and inserting a new handle member 33.

An additional aspect of the invention comprises a night glow function. The skilled artisan will know various ways in which the handle may be lit, such as a power source connected to a light emitting diode. Preferably, however, the handle and/or the ornamental element are constructed comprising a phosphorescent material that glows in the dark so as to be easily visible at night, and without requiring a power source or other electrical components. The phosphorescent material comprises at least one phosphorescent spot 37, which may itself be configured into an ornamental shape. For example, as shown in FIGS. 1, 2, and 4, the phosphorescent spot 37 is shaped as a star having seven points. By way of further example, the phosphorescent spot 37 could be incorporated into the ornamental design of distal handle end 35 by forming the eye for an ornamental fish, as seen in FIGS. 1 and 2, or into the center of an ornamental flower, as seen in FIG. 4. The phosphorescent spot may be material inlaid in the ornamental shape, or may be a surface applied material such as an adhesive overlay containing phosphorescent material.

Another aspect of the invention includes a method of advertising by positioning a promotional logo, trademark, or other advertisement as the ornamental design of distal handle end 35. Toilets are generally made available wherever the public congregates, for example, in stores, and sports venues. The present invention provides a method of advertising which is easily incorporated into any existing toilet facility. Additionally, the invention may be used and given away as business promotional items which carry an advertiser's trademark. The invention could further be marketed in a wide variety of commercial designs, for example, a line of children's cartoon characters.

In operation the handle device 20 is connected to a surface, for example, the undersurface of a toilet seat 23, toilet lid 25, or other article by first connecting the connecting member 21 in place thereon. FIG. 3 shows the detail of connecting member 21, and FIG. 1 shows the connecting member positioned connected to the undersurface of a toilet seat 35. It should be understood that the connection between connecting member 21 and the article may be accomplished in any effective manner, but is preferably an adhesive connection. Connecting member 21 is oriented so that when connecting end 31 is inserted into connecting slot 29, the handle member 33 of the handle device 20 extends beyond a lateral periphery of toilet seat 23 or toilet lid 25, as illustrated in FIG. 1. A user may then lift the toilet seat 23 or toilet lid 25 with minimal contact by placing a finger under the handle device and lifting. As noted above, the handle member 22 preferably incorporates an antimicrobial compound, so as to reduce the number of microorganisms on the handle, thereby providing an added degree of comfort regarding microbial transmission from one user to another, or from the toilet to the user. The handle member 22 and/or the handle ornamental design 35 may comprise a predetermined color, and preferably a phosphorescent compound which will glow in a predetermined color. A handle positioned on the toilet seat 23 may, for example, glow in a different phosphorescent color from a handle positioned on the toilet lid 25, so as to help the user differentiate between the two in the dark.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A disposable handle for an article, comprising:

a connecting member connected to a surface of the article; and a handle member having a proximal connecting end connected to said connecting member and a distal handle end, wherein the handle member is fabricated from a material which contains incorporated within the material an air freshening scent and an antimicrobial agent, and wherein the handle member further comprises a phosphorescent material producing a glow to help a user locate the handle member in the dark.

2. The disposable handle of claim 1, wherein the handle member proximal connecting end is connected to said connecting member so as to position the distal handle end extending outwardly from an outer periphery of the article to provide a handle therefor.

3. The disposable handle of claim 1, wherein the connecting member is connected by an adhesive connection.

4. The disposable handle of claim 1, wherein the connecting member is connected by double-sided adhesive tape.

5. The disposable handle of claim 1, further comprising a shim for leveling the connecting member when connecting to a toilet seat having a curved surface.

6. The disposable handle of claim 1, further comprising a decorative design.

7. The disposable handle of claim 1, further comprising a decorative design including a promotional logo.

8. The disposable handle of claim 1, further comprising a decorative design including a trademark.

9. The disposable handle of claim 1, wherein the handle member comprises a decorative design coordinated with the air freshening scent.

10. The disposable handle of claim 1, wherein the handle member comprises a color coordinated with the air freshening scent.

11. The disposable handle of claim 1, wherein the phosphorescent material comprises a decorative shape.

12. The disposable handle of claim 1, wherein the phosphorescent material comprises a star.

13. The disposable handle of claim 1, wherein the article is selected from the group consisting of lids and drawers.

14. The disposable handle of claim 1, wherein the article is part of a toilet.

15. A method of sanitarily handling an article in the dark while simultaneously freshening the air, the method comprising:

connecting to the article a handle member fabricated from a material which contains incorporated therein an air diffusible freshening scent and an antimicrobial agent effective for reducing microbial contamination on the handle member, the handle member further comprising a phosphorescent material producing a glow to help a user locate the handle member in the dark; and handling the article by the handle member.

16. The method of claim 15, wherein connecting comprises adhering.

* * * * *